US009617098B2

(12) United States Patent
Mizuno

(10) Patent No.: US 9,617,098 B2
(45) Date of Patent: Apr. 11, 2017

(54) IMAGE FORMING APPARATUS

(71) Applicant: KYOCERA Document Solutions Inc., Osaka (JP)

(72) Inventor: Masahiko Mizuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 109 days.

(21) Appl. No.: 14/712,463

(22) Filed: May 14, 2015

(65) Prior Publication Data

US 2015/0329301 A1 Nov. 19, 2015

(30) Foreign Application Priority Data

May 19, 2014 (JP) ..... 2014-103008

(51) Int. Cl.
*B65H 9/00* (2006.01)
*B65H 5/06* (2006.01)

(52) U.S. Cl.
CPC ..... *B65H 9/006* (2013.01); *B65H 5/062* (2013.01); *B65H 2403/20* (2013.01); *B65H 2403/42* (2013.01); *B65H 2403/72* (2013.01); *B65H 2404/611* (2013.01)

(58) Field of Classification Search
CPC ..... B65H 9/006; B65H 2403/48; B65H 2403/722; B65H 2403/42
USPC ..... 271/10.04
See application file for complete search history.

(56) References Cited

U.S. PATENT DOCUMENTS 6,446,954 B1 * 9/2002 Lim ..... B65H 3/06 271/10.04
7,664,431 B2 * 2/2010 Jang ..... G03G 15/757 399/167
9,139,391 B2 * 9/2015 Nakamura ..... B65H 7/20
9,162,836 B2 * 10/2015 Saito ..... F16D 3/12
2005/0133982 A1 * 6/2005 Kim ..... B65H 5/06 271/122

FOREIGN PATENT DOCUMENTS

JP 62-79150 A 4/1987

* cited by examiner

*Primary Examiner* — Michael McCullough
(74) *Attorney, Agent, or Firm* — Stein IP, LLC

(57) ABSTRACT

An image forming apparatus has a registration roller pair, an upstream-side roller pair, a driving force source, a shared clutch, and an upstream-side roller stop delay mechanism. The upstream-side roller pair is provided on the upstream side of the registration roller pair with respect to the sheet transport direction. The driving force source generates a rotating driving force. The shared clutch engages and disengages the transmission of the rotating driving force from the driving force source to the registration roller pair and the upstream-side roller pair. When the transmission of the rotating driving force is disengaged by the shared clutch, the upstream-side roller stop delay mechanism delays the stopping of the upstream-side roller pair relative to the stopping of the registration roller pair.

5 Claims, 13 Drawing Sheets

IMAGE FORMING APPARATUS

INCORPORATION BY REFERENCE

This application is based upon and claims the benefit of priority from the corresponding Japanese Patent Application No. 2014-103008 filed on May 19, 2014, the entire contents of which are incorporated herein by reference.

BACKGROUND

The present disclosure relates to an image forming apparatus. More particularly, the present invention relates to an image forming apparatus that includes a registration roller pair which corrects skew of sheets and which adjusts the timing of sheet transport in a manner coordinated with the timing of image formation.

Some known image forming apparatuses include a registration roller pair which corrects skew of sheets and which adjusts the timing of sheet transport in a manner coordinated with the timing of image formation and an upstream-side roller pair which is provided on the upstream side of the registration roller pair with respect to the sheet transport direction.

To correct skew of a sheet, the sheet needs to be warped (slackened) at the registration roller pair. Specifically, with the rotation of the registration roller pair stopped, the head end of the sheet is put in contact with the registration roller pair, and the upstream-side roller pair is rotated slightly in the forward direction so as to warp the sheet. In this way, skew of a sheet is corrected. Accordingly, it is common to drive and control the registration roller pair and the upstream-side roller pair with separate motors (driving force sources) respectively or, in a case where they are driven with a single motor, to provide separate clutches between the motor and the roller pairs respectively to control each roller pair individually.

SUMMARY

According to one aspect of the present disclosure, an image forming apparatus includes a registration roller pair, an upstream-side roller pair, a driving force source, a shared clutch, and an upstream-side roller stop delay mechanism. The registration roller pair corrects skew of a sheet, and adjusts the timing of sheet transport in a manner coordinated with timing of image formation. The upstream-side roller pair is provided on the upstream side of the registration roller pair with respect to the sheet transport direction. The driving force source generates a rotating driving force for rotating the registration roller pair and the upstream-side roller pair. The shared clutch engages and disengages the transmission of the rotating driving force from the driving force source to the registration roller pair and the upstream-side roller pair. The upstream-side roller stop delay mechanism operates such that, when the transmission of the rotating driving force is disengaged by the shared clutch, the stopping of the upstream-side roller pair is delayed relative to the stopping of the registration roller pair.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Hereinafter, embodiments of the present disclosure will be describe with reference to the accompanying drawings.

Figure 1:
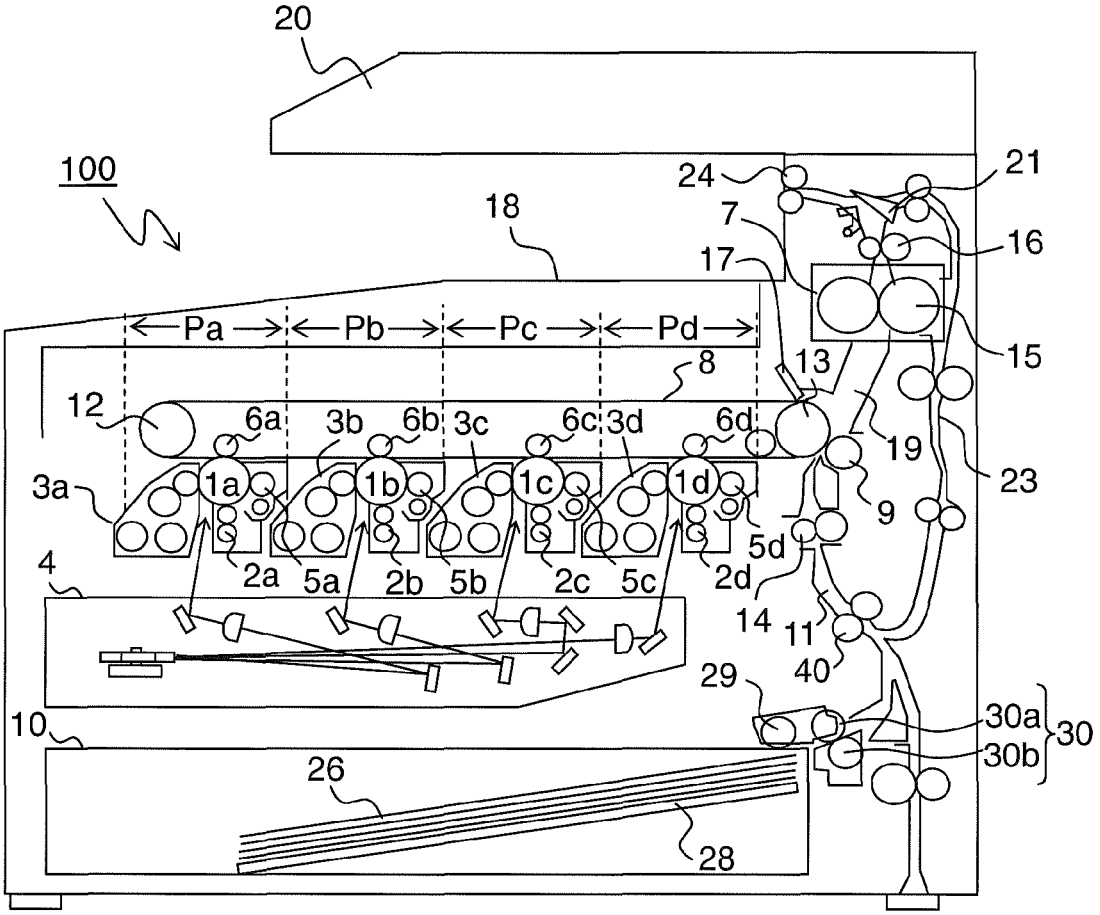
FIG. 1 is a sectional view showing an overall construction of an image forming apparatus according to one embodiment of the present disclosure.

With reference to FIGS. 1 to 12, an image forming apparatus 100 according to one embodiment of the present disclosure will be described. As shown in FIG. 1, the image forming apparatus 100 is a tandem-type color copier. Inside the body of the image forming apparatus 100, four image forming sections Pa, Pb, Pc, and Pd are arranged in this order from left to right in FIG. 1. The image forming sections Pa to Pd are provided to correspond to images of four different colors (yellow, magenta, cyan, and black), and sequentially form a yellow, a magenta, a cyan, and a black image, respectively, each through processes of electrostatic charging, exposure to light, image development, and transfer.

The image forming sections Pa to Pd respectively include photosensitive drums 1*a*, 1*b*, 1 *c*, and 1*d* which carry visible images (toner images) of the different colors. An intermediary transfer belt 8 which rotates in the counter-clockwise direction in FIG. 1 is provided to abut on the image forming sections Pa to Pd. The toner images formed on the photosensitve drums 1*a* to 1 *d* are sequentially transferred to the intermediary transfer belt 8, which moves while keeping contact with the photosensitve drums 1*a* to 1*d*, so as to be superimposed on one another. Those images are then, by the action of a second transfer roller 9, transferred to a sheet 26 of paper as an example of a recording medium. The images are then fused to the sheet 26 in a fusing device 7. The sheet is then discharged out of the apparatus body. While the photosensitve drums 1*a* to 1*d* are rotated in the clockwise direction in FIG. 1, an image formation process is performed with respect to each of the photosensitve drums 1*a* to 1*d*.

The sheet 26 to which the toner images are transferred is contained in a sheet feed cassette (sheet stacking portion) 10. The sheet 26 is placed on a sheet placement plate 28 in the sheet feed cassette 10. When a pickup roller 29 is rotated with the top face of the sheet 26 pressed against the pickup roller 29 under a predetermined pressure, the sheet 26 starts to be fed out. Out of a plurality of sheets 26, the topmost one of is separated by a transport roller pair 30, and is transported toward a sheet transport passage 11. The sheet 26 that has passed through the sheet transport passage 11 reaches a registration roller pair 14 via an intermediary roller pair 40 (upstream-side roller pair), and is transported on to a nip portion between a secondary transfer roller 9 and a driving roller 13 of the intermediary transfer belt 8 in a manner coordinated with the timing of image formation.

Used as the intermediary transfer belt 8 is a sheet of dielectric resin, which typically is a belt with no seam (seamless belt). On the downstream side of the secondary transfer roller 9 with respect to the movement direction of the intermediary transfer belt 8, there is arranged a cleaning blade 17 for removing toner that is left behind on the surface of the intermediary transfer belt 8.

An image reading section 20 includes a scanner lamp for illuminating a document during copying, a scanning optical system including a mirror for changing the optical path of the light reflected from the document, a condenser lens for condensing and imaging the light reflected from the document, and a CCD sensor or the like for converting the imaged light (image light) into an electrical signal (none of these is illustrated). The image reading section 20 reads a document and converts it into image data.

Next, the image forming sections Pa to Pd will be described. Around and under the photosensitve drums 1*a* to 1*d* which are rotatably arranged, there are provided charging devices 2*a*, 2*b*, 2*c*, and 2*d* for electrostatically charging the photosensitve drums 1*a* to 1*d*, an exposing device 4 for exposing the photosensitve drums 1*a* to 1*d* to light carrying image information, developing devices 3*a*, 3*b*, 3*c*, and 3*d* for forming toner images on the photosensitve drums 1*a* to 1*d*, and cleaning devices 5*a*, 5*b*, 5*c*, and 5*d* for removing developer (toner) that is left behind on the photosensitve drums 1*a* to 1*d*.

When image data is fed in from the image reading section 20, first, the charging devices 2*a* to 2*d* electrostatically charge the surfaces of the photosensitve drums 1*a* to 1*d* uniformly. Then, the exposing device 4 irradiates the photosensitve drums 1*a* to 1*d* with a light beam based on the image data so that electrostatic latent images based on the image data from the image reading section 20 are formed on the photosensitve drums 1*a* to 1 *d*. The developing devices 3*a* to 3*d* include developing rollers (developer carriers) which are arranged opposite the photosensitve drums 1*a* to 1*d* respectively, and are charged with predetermined amounts of two-component developer containing yellow, magenta, cyan, and black toner respectively. The toner is fed by the developing rollers in the developing devices 3*a* to 3*d* to the photosensitve drums 1*a* to 1*d*, and electrostatically attaches to them, thereby forming toner images based on the electrostatic latent images formed through exposure to light from the exposing device 4.

Primary transfer rollers 6*a* to 6*d* apply electric fields of a predetermined transfer voltage between the primary transfer rollers 6*a* to 6*d* and the photosensitve drums 1*a* to 1*d*, and thus the yellow, magenta, cyan, and black toner images on the photosensitve drums 1*a* to 1 *d* are primarily transferred to the intermediary transfer belt 8. These images of four colors are formed in a positional relationship that is previously determined for formation of a predetermined full-color image. Thereafter, in preparation for subsequent formation of new electrostatic latent images, the toner that is left behind on the surfaces of the photosensitve drums 1*a* to 1*d* is removed by the cleaning devices 5*a* to 5*d*.

The intermediary transfer belt 8 is wound around a driven roller 12 and a driving roller 13. When the driving roller 13 is rotated by a belt driving motor (unillustrated) and as a result the intermediary transfer belt 8 starts to rotate in the counter-clockwise direction, the sheet 26 is transported, with predetermined timing, from the registration roller pair 14 to the nip portion (secondary nip portion) between the secondary transfer roller 9, which is provided close to the intermediary transfer belt 8, and the intermediary transfer belt 8. In the nip portion, a full-color image is secondarily transferred to the sheet 26. The sheet 26 having the toner images transferred to it is transported to the fusing device 7.

In the fusing device 7, as the sheet 26 passes through a nip portion (fusing nip portion) between a fusing roller pair 15, the sheet 26 is heated and pressed so that the toner images are fused to the surface of the sheet 26, forming a predetermined color image. The sheet 26 having the full-color image formed on it passes through a transfer roller pair 16 and is branched between different transport directions by a transport guide member 21 arranged in a bifurcated portion of a sheet transport passage 19. In a case where only one side of the sheet 26 is subjected to image formation, the sheet 26 is directly discharged onto a discharge tray 18 via a discharge roller pair 24.

On the other hand, in a case where both sides of the sheet 26 are subjected to image formation, part of the sheet 26 that has passed through the fusing device 7 is momentarily stuck out of the apparatus body. Then, after the tail end of the sheet 26 has passed through the bifurcated portion of the sheet transport passage 19, the discharge roller pair 24 is rotated in the reverse direction, and the transport guide member 21 is so operated as to switch transport directions. Thus, the sheet 26 is branched into a both-side transport passage 23, and is, with the image side reversed, transported once again to the secondary transfer nip portion. Then, the next toner images formed on the intermediary transfer belt 8 are secondarily transferred by the secondary transfer roller 9 to the side of the sheet 26 on which no images have been formed yet. The sheet 26 having the toner images secondarily transferred to it is transported to the fusing device 7, where the toner images are fused, and is then discharged onto the discharge tray 18.

Next, the roller arrangement around the sheet transport passages 11 and 19 and the both-side transport passage 23 will be described.

Figure 2:
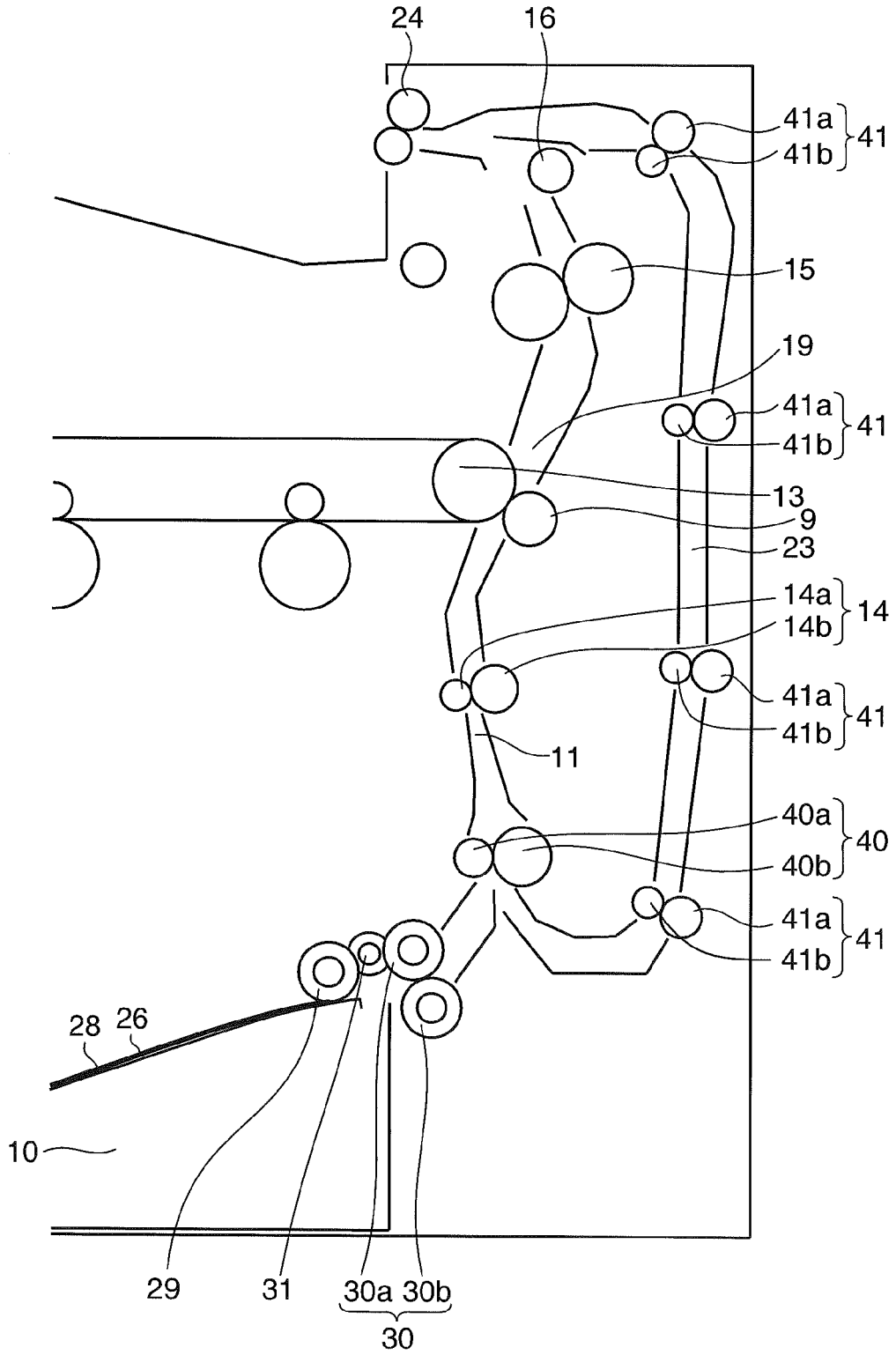
FIG. 2 is a sectional view showing a structure around a sheet transport passage and a both-side transport passage in an image forming apparatus according to one embodiment of the present disclosure.

As shown in FIG. 2, in the sheet transport passage 11, close to the sheet feed cassette 10, there are provided a pickup roller 29 and a transport roller pair 30. The pickup roller 29 feeds the sheet 26 out of the sheet feed cassette 10. The transport roller pair 30 is composed of a feed roller 30*a*, which transports the sheet 26 fed out by the pickup roller 29, and a retard roller 30*b*, which is arranged opposite the feed roller 30*a* and which is pressed against the feed roller 30*a* to form a nip portion for transporting the sheet 26.

The feed roller 30*a* and the retard roller 30*b* are configured so as to transport one sheet 26 after another fed from the pickup roller 29. Specifically, the transport roller pair 30 is configured to rotate by receiving a driving force from a driving motor 70, which will be described later. The retard roller 30*b* is configured to rotate together with the feed roller 30*a* by being in pressed contact with it, and incorporates a torque limiter. Moreover, between the feed roller 30*a* and the pickup roller 29, there is arranged a transmission gear 31 which transmits the rotation of the feed roller 30*a* to the pickup roller 29. Thus, when the pickup roller 29 in pressed contact with the sheet 26 is rotated, the sheet 26 starts to be fed out. If more than one sheet 26 are simultaneously fed out by the pickup roller 29, the feed roller 30*a* and the retard roller 30*b* separate the sheets 26 so that only the topmost one is fed out toward the sheet transport passage 11. The transmission gear 31 is arranged at one end (the end farther away from the viewer of FIG. 2) of the pickup roller 29 and the transport roller pair 30, and is meshed with an unillustrated gear provided on the rotary shaft of the pickup roller 29 and an unillustrated gear provided on the rotary shaft of the feed roller 30*a*.

On the downstream side of the transport roller pair 30, an intermediary roller pair 40 is provided, and near the upstream side of the intermediary roller pair 40, the both-side transport passage 23 joins the sheet transport passage 11. The intermediary roller pair 40 is composed of an intermediary driving roller 40*a*, which rotates by receiving a driving force from the driving motor 70, which will be described later, and an intermediary driven roller 40*b*, which rotates together with the intermediary driving roller 40*a* by being in pressed contact with it. The intermediary driving roller 40*a* of the intermediary roller pair 40 is configured so as to put the head end of the sheet 26 in contact with the registration roller pair 14 with the rotation of the registration roller pair 14 stopped and then further rotate to make the sheet 26 warp. The structure of the intermediary driving roller 40*a* will be described in detail later.

The registration roller pair 14 is composed of a registration driving roller 14*a*, which rotates by receiving a driving force from the driving motor 70, which will be described later, and a registration driven roller 14*b*, which rotates together with the registration driving roller 14*a* by being in pressed contact with it.

Along the both-side transport passage 23, there are provided a plurality of (here, four) both-side transport roller pairs 41. Each both-side transport roller pair 41 is composed of a both-side transport driving roller 41*a*, which rotates by receiving a driving motor driving motor 70, which will be described later, and a both-side transport driven roller 41*b*, which rotates together with the both-side transport driving roller 41*a* by being in pressed contact with it. Moreover, here, as will be described later, a configuration is adopted such that, when one both-side transport roller pair 41 rotates, all the both-side transport roller pairs 41 rotate.

Next, a description will be given of the transmission path of the rotating driving force from the driving motor 70 to individual driving rollers.

Figure 3:
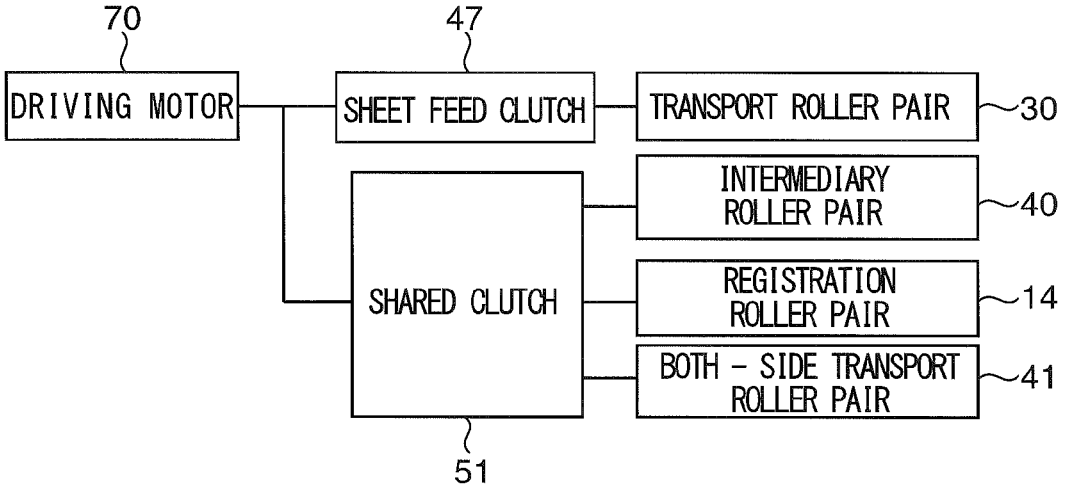
FIG. 3 is a block diagram showing, in a simplified manner, a transmission path of a rotating driving force from a driving motor to individual driving rollers in an image forming apparatus according to one embodiment of the present disclosure.
Figure 4:
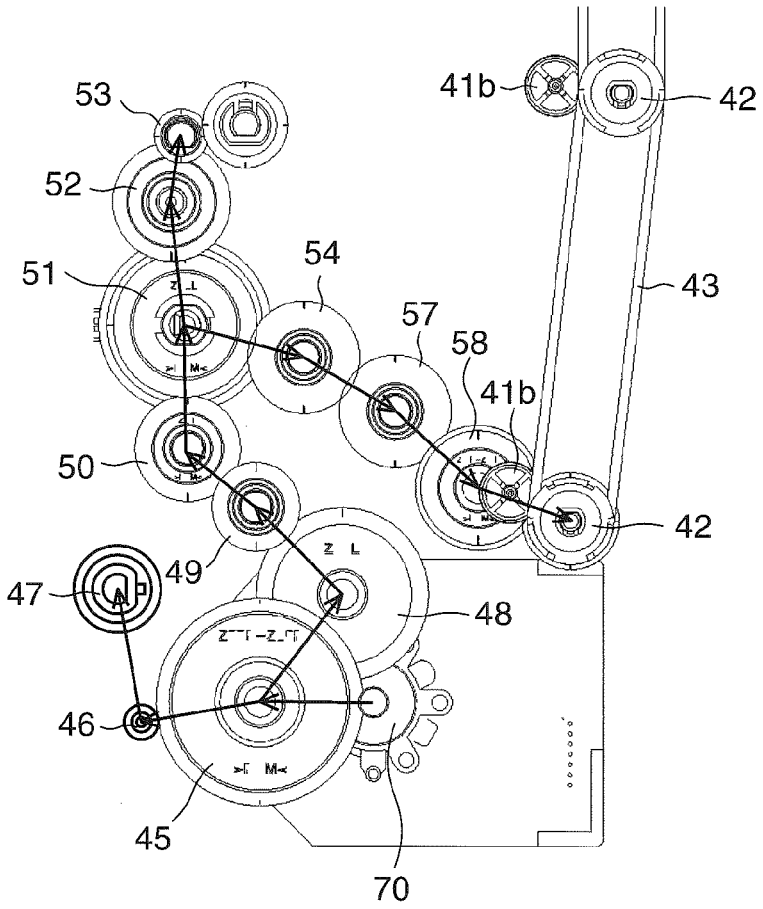
FIG. 4 is a side view illustrating a transmission path of a rotating driving force from a driving motor to individual driving rollers in an image forming apparatus according to one embodiment of the present disclosure.

As described above, the feed roller 30*a*, the intermediary driving roller 40*a*, the registration driving roller 14*a*, and the both-side transport driving rollers 41*a* receive a rotating driving force from the single driving motor 70 (driving force source) shown in FIGS. 3 and 4. The driving motor 70 is fixed, at one side of the image forming apparatus 100, to its cabinet (the side farther away from the viewer of FIG. 2). Also provided at one side of the image forming apparatus 100 are the later-described transmission gears, clutches, etc. for transmitting the driving force from the driving motor 70.

As shown in FIG. 4, the driving motor 70 is coupled, via transmission gears 45 and 46, with a sheet feed clutch 47. The sheet feed clutch 47 is fitted on the rotary shaft of the feed roller 30*a* (see FIG. 2), and depending on whether the sheet feed clutch 47 is on or off, the feed roller 30*a* rotates or remains at rest. Thus, the sheet feed clutch 47 engages and disengages the transmission of the rotating driving force from the driving motor 70 to the feed roller 30*a*.

Figure 5:
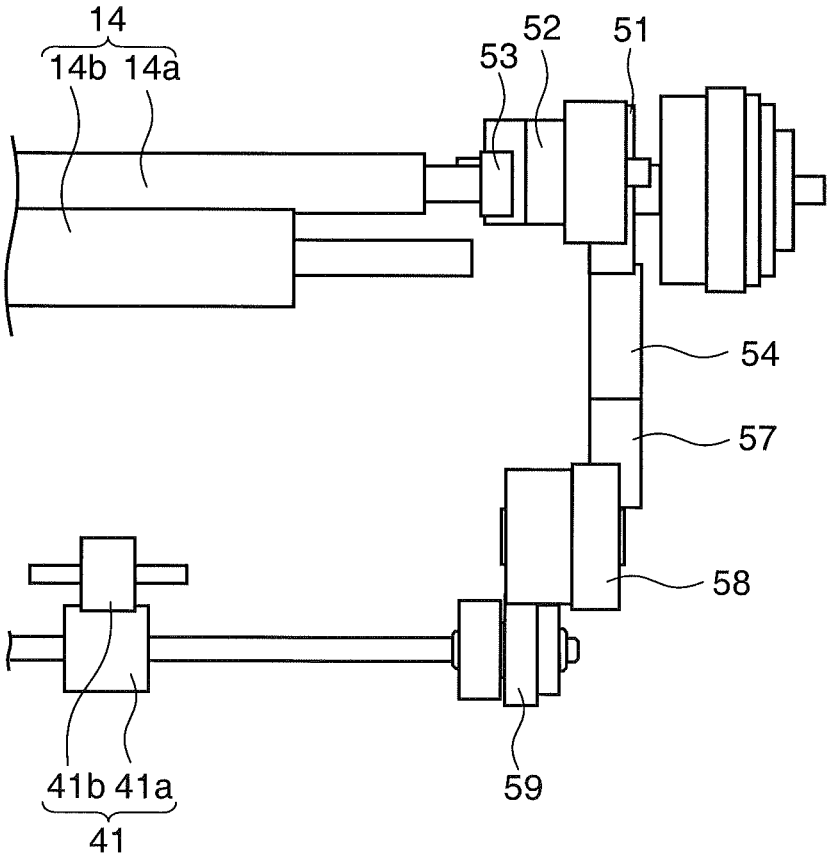
FIG. 5 is a plan view showing a transmission path of a rotating driving force from a shared clutch to a registration driving roller and a both-side transport driving roller in an image forming apparatus according to one embodiment of the present disclosure.

The transmission gear 45 is coupled, via transmission gears 48, 49, and 50, with a shared clutch 51. As shown in FIGS. 4 and 5, the shared clutch 51 is coupled, via a transmission gear 52, with a registration roller gear 53. The registration roller gear 53 is fitted on the rotary shaft of the registration driving roller 14*a*, and depending on whether the shared clutch 51 is on or off, the registration driving roller 14*a* rotates or remains at rest. FIGS. 4 and 5 omit a transmission gear 55, an intermediary roller gear 56, and an intermediary roller pair 40, which will be described later.

Figure 6:
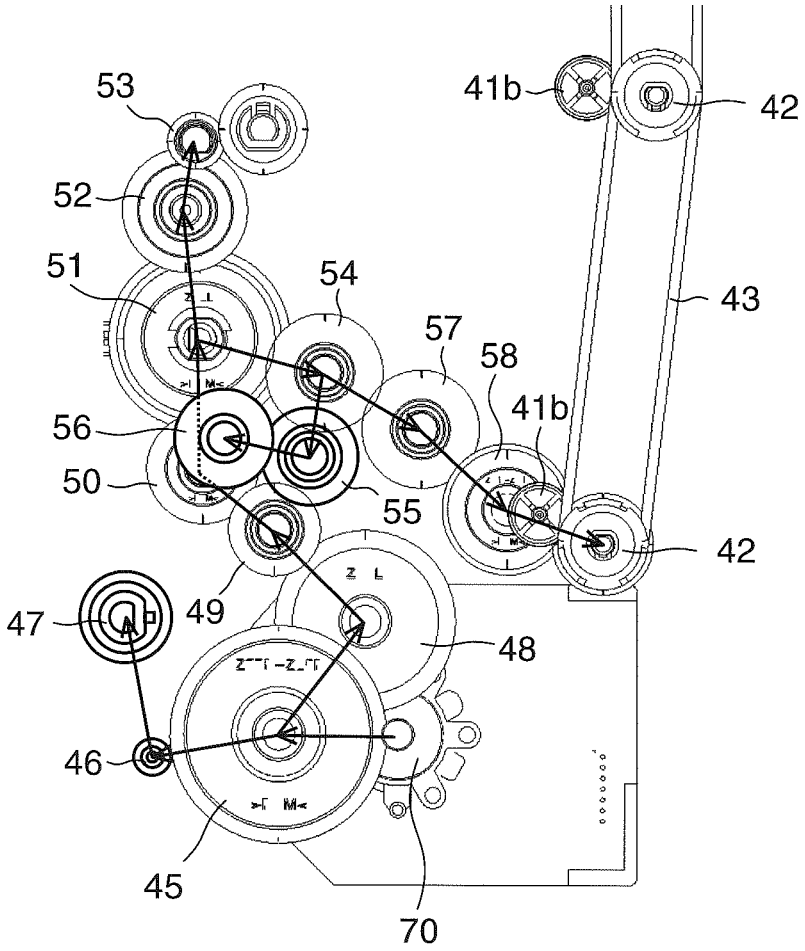
FIG. 6 is a side view illustrating a transmission path of a rotating driving force from a driving motor to individual driving rollers in an image forming apparatus according to one embodiment of the present disclosure.

As shown in FIG. 6, the shared clutch 51 is coupled, via transmission gears 54 and 55, with an intermediary roller gear 56 (driving force transmission gear). The intermediary roller gear 56 is fitted on the rotary shaft of the intermediary driving roller 40*a* (see FIG. 2), and depending on the shared clutch 51 is on or off, the intermediary driving roller 40*a* rotates or remains at rest.

As shown in FIG. 5, the transmission gear 54 is coupled, via transmission gears 57 and 58, with a both-side transport roller gear 59. The both-side transport roller gear 59 is fitted on the rotary shaft of each both-side transport driving roller 41*a*. The rotary shafts of the four both-side transport driving rollers 41*a* (see FIG. 2) are respectively fitted with driving force transmission rollers 42 (see FIG. 4). As shown in FIG. 4, the four driving force transmission rollers 42 have a belt member 43 wound around them. Accordingly, when a driving force is transmitted to one driving force transmission roller 42, it is transmitted to the other driving force transmission rollers 42. Thus, depending on whether the shared clutch 51 is on or off, all the driving force transmission rollers 42 and all the both-side transport driving rollers 41*a* rotate or remain at rest.

As described above, the shared clutch 51 engages and disengages the transmission of the driving force from the driving motor 70 to the registration driving roller 14*a*, the intermediary driving roller 40*a*, the driving force transmission rollers 42, and the both-side transport driving rollers 41*a*.

Next, a description will be given of the structure around one end of the rotary shaft 40*c* of the intermediary driving roller 40*a*.

Figure 7:
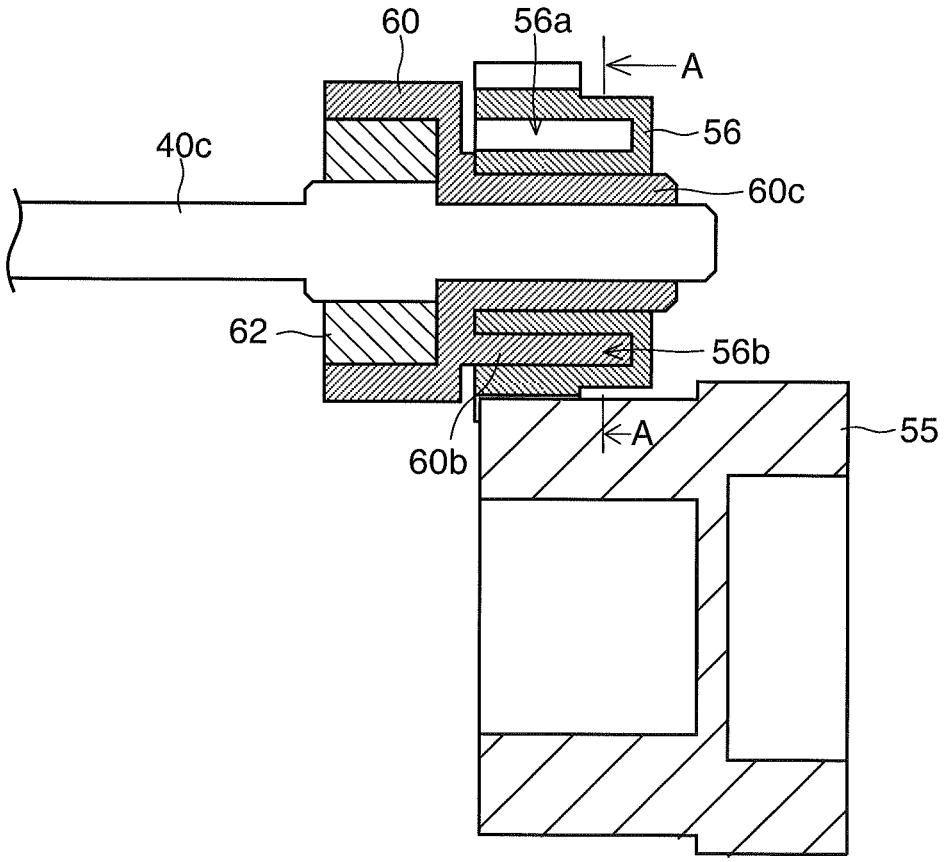
FIG. 7 is a sectional view showing a structure around one end of a rotary shaft of an intermediary driving roller in an image forming apparatus according to one embodiment of the present disclosure.

As shown in FIG. 7, the rotary shaft 40*c* of the intermediary driving roller 40*a* is, at one end, fitted with a driving force transmission member 60, and with an intermediary roller gear 56 which transmits the driving force from the transmission gear 55 to the driving force transmission member 60. The driving force transmission member 60 is fitted on the rotary shaft 40*c* via a one-way clutch 62. The intermediary roller gear 56 is fitted on the driving force transmission member 60 with a clearance (gap) left relative to the driving force transmission member 60 with respect to the rotation direction. The driving force transmission member 60, the intermediary roller gear 56, and a biasing member 61, which will be described later, together constitute an upstream-side roller stop delay mechanism for delaying the stopping of the intermediary roller pair 40 relative to the stopping of the registration roller pair 14.

Figure 8:
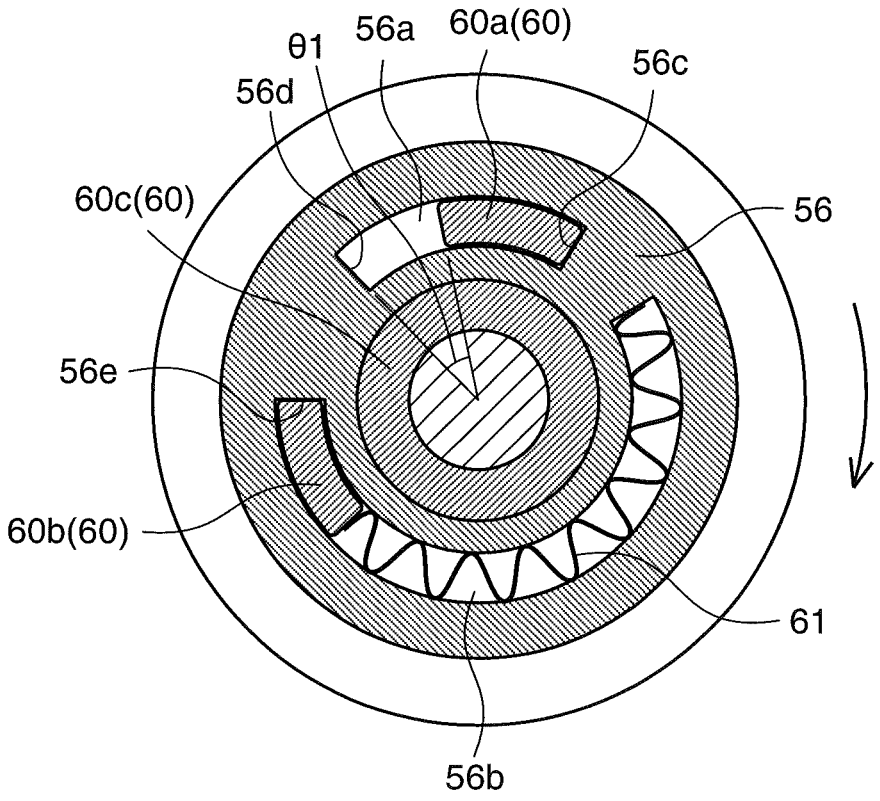
FIG. 8 is a sectional view across line A-A in FIG. 7, showing a structure around one end of a rotary shaft of an intermediary driving roller as observed in a state where an intermediary roller gear and a driving force transmission member are at rest.

As shown in FIG. 8, the intermediary roller gear 56 has formed in it a first engagement groove 56*a* and a second engagement groove 56*b* each with a predetermined rotation angle and a predetermined length in the circumferential direction. Compared with the first engagement groove 56*a*, the second engagement groove 56*b* is formed with a larger circumferential-direction angle (rotation-direction angle) about the same rotation center, and hence with a larger circumferential-direction length.

On a side face of the driving force transmission member 60, there are formed a first engagement projection 60*a*, which is inserted in, and engages with, the first engagement groove 56*a* having an arc shape; a second engagement projection 60*b*, which is inserted in, and engages with, the second engagement groove 56*b* having an arc shape; and a cylindrical portion 60*c*, which is arranged in a central part and which is fitted into the intermediary roller gear 56. The rotary shaft 40*c* is inserted through the cylindrical portion 60*c*, so that the cylindrical portion 60*c*, the first engagement projection 60*a*, and the second engagement projection 60*b* together rotate about the rotary shaft 40*c*.

In the first engagement groove 56*a*, a gap is formed that allows the first engagement projection 60*a* to rotate through a predetermined angle θ1 relative to the first engagement groove 56*a*. In the second engagement groove 56*b*, a space (gap) larger than the angle θ1 is formed against the second engagement projection 60*b*. In this space (in the second engagement groove 56*b*) is arranged a biasing member 61 such as a compression spring for biasing the second engagement projection 60*b* in the forward rotation direction of the driving force transmission member 60 (in the clockwise direction in FIG. 8, in which it rotates during image formation).

When the intermediary roller gear 56 and the driving force transmission member 60 are at rest, as shown in FIG. 8, the first engagement projection 60*a* abuts on an inner side face 56*c* of the first engagement groove 56*a* in the forward rotation direction (clockwise direction), and the second engagement projection 60*b* abuts on an inner side face 56*e* of the second engagement groove 56*b* in the forward rotation direction. Not both the first and second engagement projections 60*a* and 60*b* need to abut on the corresponding inner side faces of the engagement grooves; a configuration is also possible where only one of them abuts on the corresponding inner side face 56*c* or 56*e*.

Figure 9:
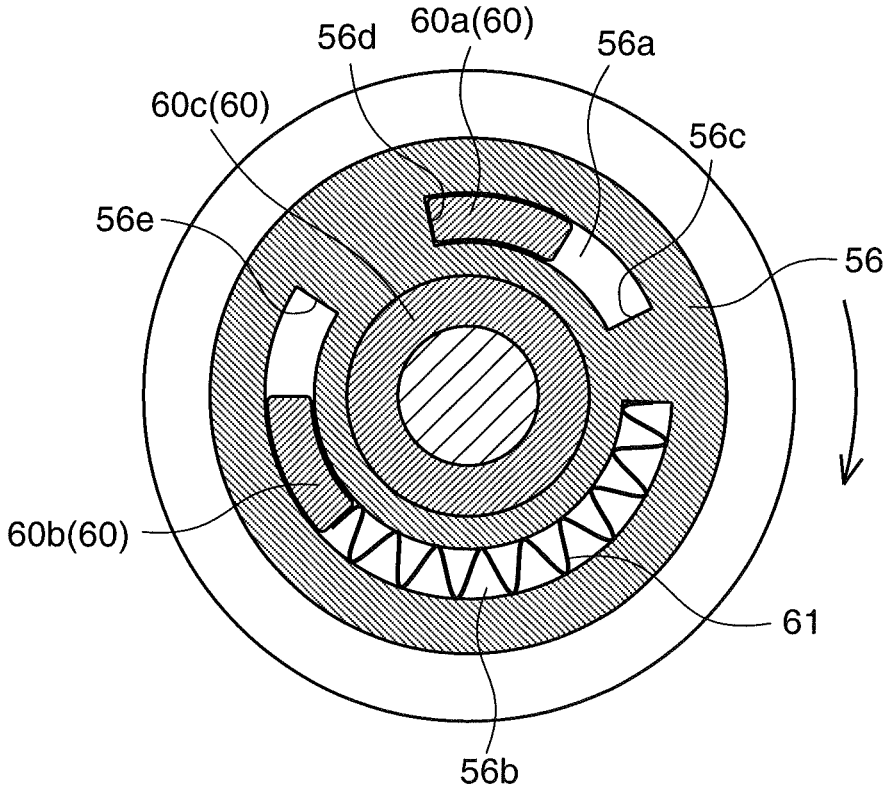
FIG. 9 is a sectional view showing a structure around one end of a rotary shaft of an intermediary driving roller as observed in a state where an intermediary roller gear and a driving force transmission member are rotating.

On the other hand, when the driving force is being transmitted to the intermediary roller gear 56 via the transmission gear 55 and thus the intermediary roller gear 56 and the driving force transmission member 60 are rotating, as shown in FIG. 9, the first engagement projection 60*a* abuts on an inner side face 56*d* of the first engagement groove 56*a* in the reverse rotation direction (counter-clockwise direction). That is, as a result of the intermediary roller gear 56 rotating in the forward direction, the inner side face 56*d* of the first engagement groove 56*a* abuts on the first engagement projection 60*a*, and makes the first engagement projection 60*a* (driving force transmission member 60) rotate in the forward direction. Now, the biasing member 61 is compressed through the angle θ1.

When the shared clutch 51 is turned off and the driving force ceases to be transmitted to the intermediary roller gear 56 via the transmission gear 55, the intermediary roller gear 56 immediately stops. Now, the resilient force (biasing force) of the biasing member 61 makes the second engagement projection 60*b* rotate further through the angle θ1 in the forward rotation direction. Eventually, the first and second engagement projections 60*a* and 60*b* abut on the inner side faces 56*c* and 56*e* respectively, and this stops the forward rotation of the second engagement projection 60*b* (driving force transmission member 60). That is, after the shared clutch 51 is turned off and the intermediary roller gear 56 stops rotating, the driving force transmission member 60 and the intermediary driving roller 40*a* rotate further through the angle θ1 and then stop.

Moreover, since the rotary shaft 40*c* of the intermediary driving roller 40*a* is provided with the one-way clutch 62 (see FIG. 7) which restricts the rotation direction of the intermediary driving roller 40*a*, the intermediary driving roller 40*a* cannot rotate in the reverse direction.

The structure around one end of the rotary shaft of the both-side transport driving roller 41*a* is similar to the structure around one end of the rotary shaft 40*c* of the intermediary driving roller 40*a*, and therefore will be described in a simplified manner below.

The rotary shaft of the both-side transport driving roller 41*a* is, at one end, fitted with a driving force transmission member (unillustrated) structured similarly to the driving force transmission member 60 and a both-side transport roller gear 59 structured similarly to the intermediary roller gear 56. The rotary shaft of the both-side transport driving roller 41*a* is fitted with a one-way clutch which restricts the rotation direction of the both-side transport driving roller 41*a*. The driving force transmission member (unillustrated), the both-side transport roller gear 59, and the biasing member 61 together constitute a both-side transport roller stop delay mechanism for delaying the stopping of the both-side transport roller pair 41 relative to the stopping of the registration roller pair 14.

Next, a description will be given of sheet transport operation (in particular, warp formation operation with respect to the sheet 26) in the image forming apparatus 100.

Figure 10:
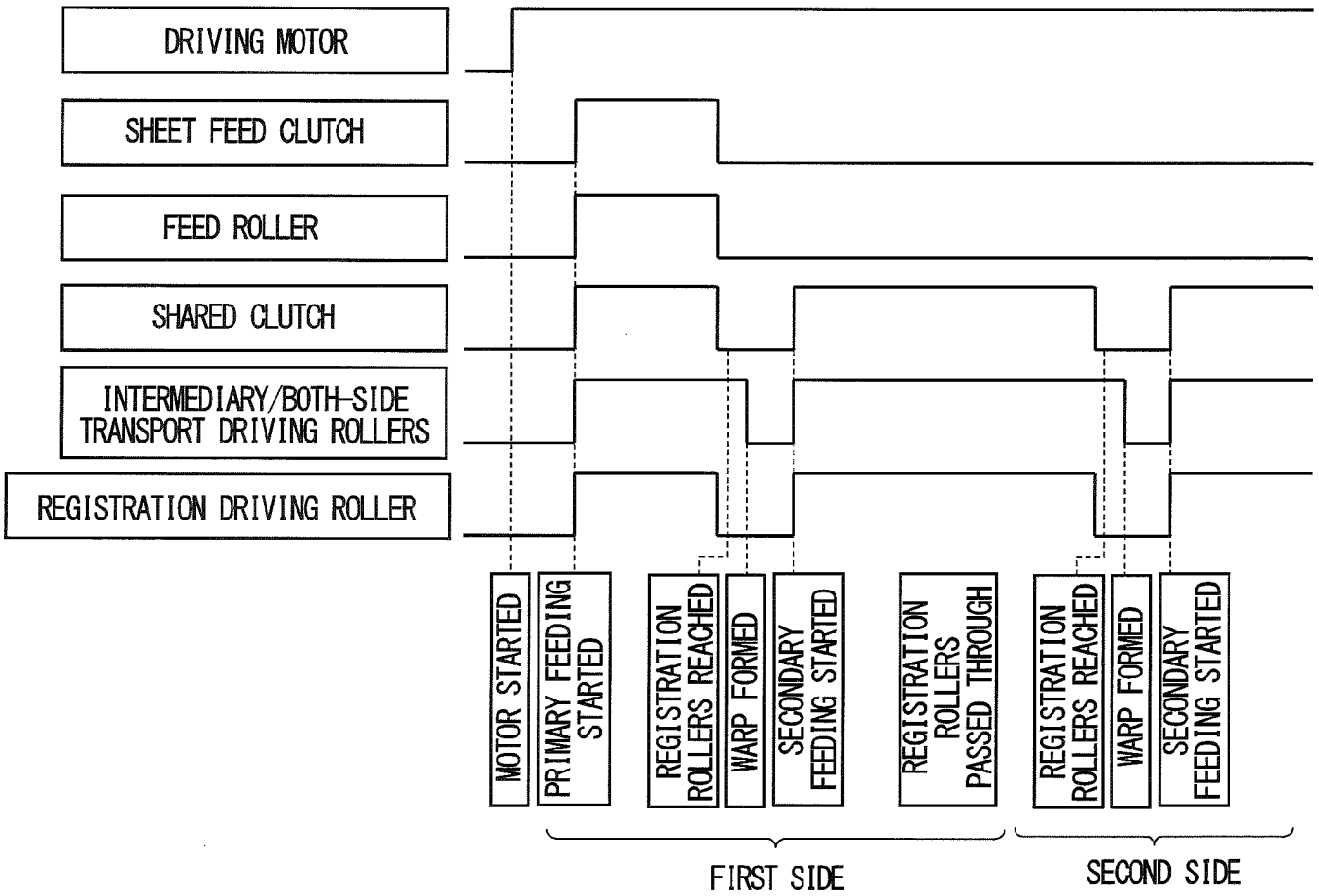
FIG. 10 is a timing chart illustrating sheet transport operation in an image forming apparatus according to one embodiment of the present disclosure.

When the image forming apparatus 100 starts image formation, as shown in FIG. 10, the driving motor 70 starts to rotate. At this point, the sheet feed clutch 47 and the shared clutch 51 are off, and thus the feed roller 30*a*, the intermediary driving roller 40*a*, the both-side transport driving roller 41*a*, and the registration driving roller 14*a* are at rest. The intermediary roller gear 56 and the driving force transmission member 60 are in the positional relationship shown in FIG. 8; specifically, the first engagement projection 60*a* abuts on the inner side face 56*c* of the first engagement groove 56*a*, and the second engagement projection 60*b* abuts on the inner side face 56*e* of the second engagement groove 56*b*. On the other hand, as shown in FIG. 2, the pickup roller 29 is in pressed contact with the head end of the sheet 26.

Figure 11A:
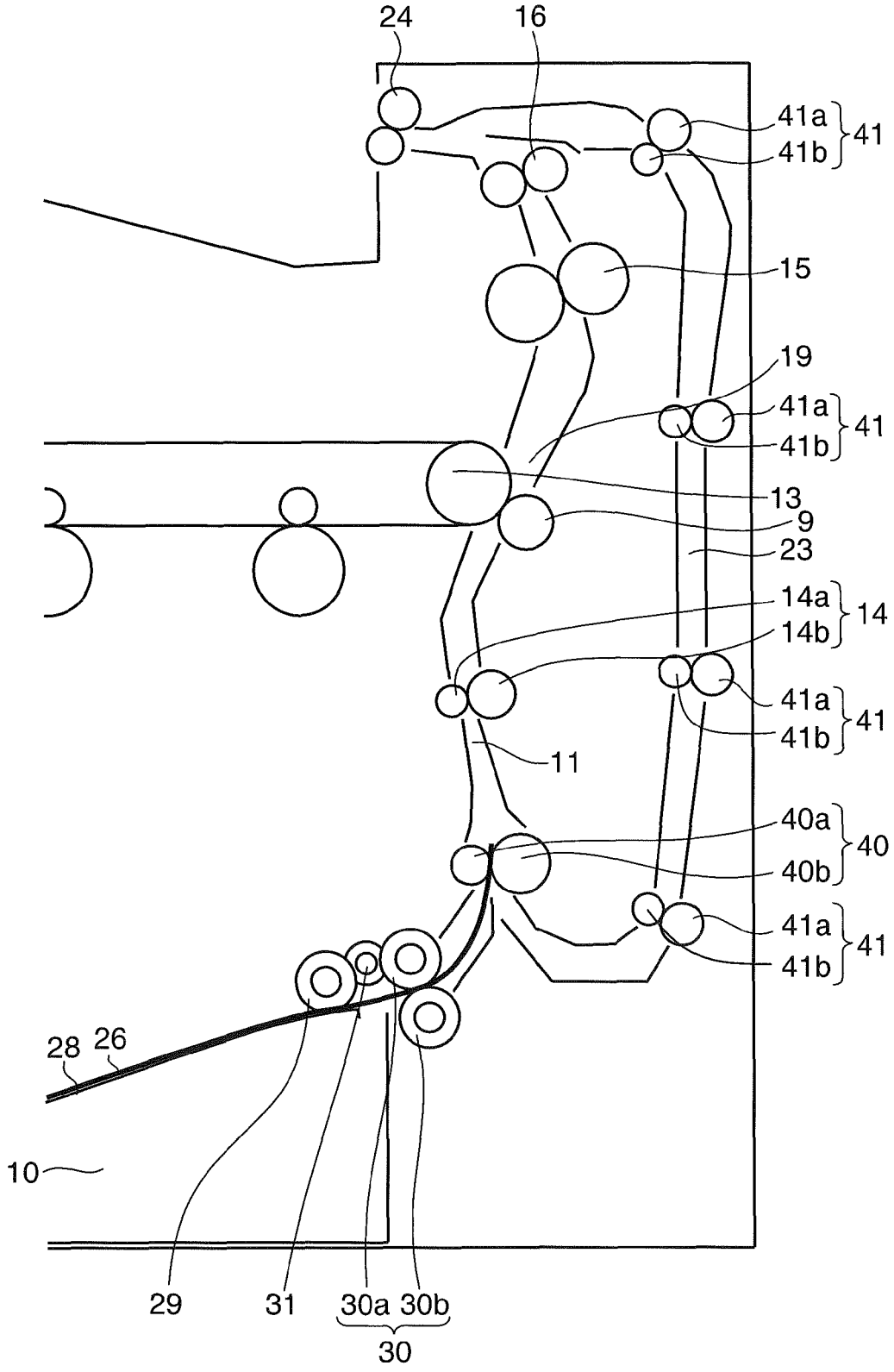
FIG. 11A is a sectional view showing a state where a sheet is being primarily fed by a transport roller pair and an intermediary roller pair in an image forming apparatus according to one embodiment of the present disclosure.
Figure 11B:
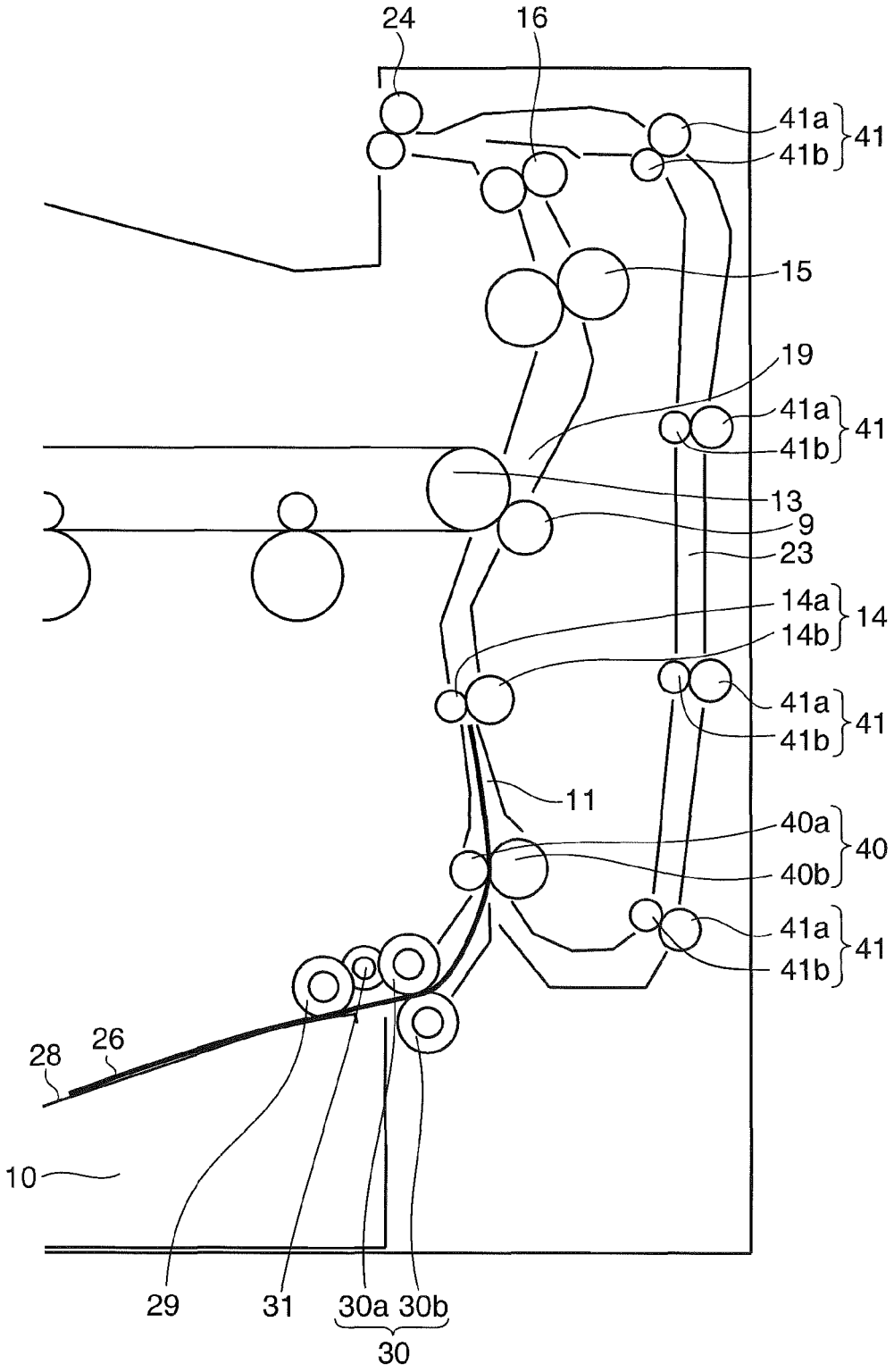
FIG. 11B is a sectional view showing a state where the head end of a sheet is about to reach a registration roller pair in an image forming apparatus according to one embodiment of the present disclosure.

Then, the sheet feed clutch 47 and the shared clutch 51 are turned on. As a result of the sheet feed clutch 47 turning on, the feed roller 30*a* and the pickup roller 29 start to rotate; as a result of the shared clutch 51 turning on, the intermediary driving roller 40*a*, the both-side transport driving roller 41*a*, and the registration driving roller 14*a* start to rotate. Thus, as shown in FIG. 11A, the sheet 26 is transported into the sheet transport passage 11 by the pickup roller 29 and the transport roller pair 30, and is then transported toward the registration roller pair 14 by the intermediary roller pair 40; thus, primary sheet feeding is started.

Now, the intermediary roller gear 56 and the driving force transmission member 60 are in the positional relationship shown in FIG. 9; specifically, the inner side face 56*d* of the first engagement groove 56*a* abuts on the first engagement projection 60*a*, and makes the first engagement projection 60*a* (driving force transmission member 60) rotate in the forward direction. On the other hand, the biasing member 61 is compressed through the angle θ1. When the shared clutch 51 is turned on, the intermediary driving roller 40*a* and the both-side transport driving roller 41*a* may start to be driven to rotate before the intermediary roller gear 56 abuts on the driving force transmission member 60, or may start to be driven to rotate as a result of the intermediary roller gear 56 rotating in the forward direction through the angle θ1 and abutting the driving force transmission member 60. The timing with which to start the driving of the intermediary driving roller 40*a* and the both-side transport driving roller 41*a* can be adjusted by adjusting the spring constant of the biasing member 61.

Thereafter, immediately before the head end of the sheet 26 reaches the registration roller pair 14 (i.e., in the state shown in FIG. 11B), the sheet feed clutch 47 and the shared clutch 51 are turned off. The position of the head end of the sheet 26 is detected by an unillustrated sensor or the like. As a result of the sheet feed clutch 47 turning off, the feed roller 30*a* and the pickup roller 29 immediately stop rotating; as a result of the shared clutch 51 turning off, the registration driving roller 14*a* immediately stops rotating.

Figure 11C:
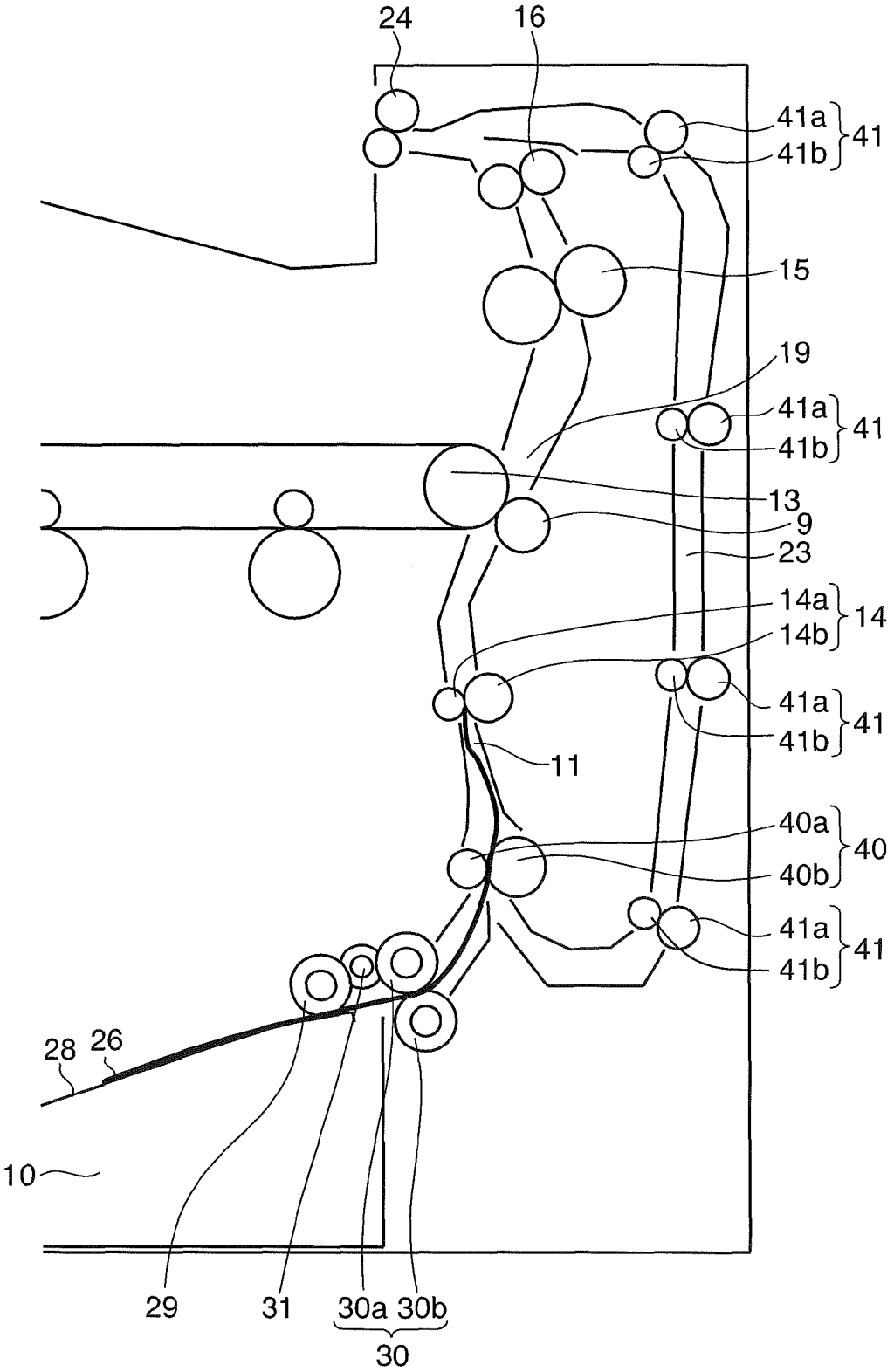
FIG. 11C is a sectional view showing a state where a warp is formed in a head-end part of a sheet by a registration roller pair and an intermediary roller pair in an image forming apparatus according to one embodiment of the present disclosure.

At this point, the intermediary driving roller 40*a* tends to stop rotating, but the resilient force (biasing force) of the biasing member 61 makes the second engagement projection 60*b* (driving force transmission member 60) rotate further through the angle θ1 in the forward rotation direction. Eventually, the first and second engagement projections 60*a* and 60*b* abut on the inner side faces 56*c* and 56*e* respectively, and the second engagement projection 60*b* (driving force transmission member 60) stops rotating in the forward direction. Thus, after the registration driving roller 14*a* stops, the intermediary driving roller 40*a* rotates further through the angle θ1 and then stops. As a result, with the head end of the sheet 26 stopped at the registration roller pair 14, the intermediary roller pair 40 feeds the sheet 26 forth an extra distance corresponding to the angle θ1. Thus, as shown in FIG. 11C, a warp is formed in a head end part of the sheet 26, and this corrects skew of the sheet 26. Since the rotary shaft of the both-side transport driving roller 41*a* is provided with a both-side transfer roller stop delay mechanism structured similarly to the upstream-side roller stop delay mechanism, the both-side transport driving roller 41*a* behaves similarly to the intermediary driving roller 40*a*; that is, after the registration driving roller 14*a* stops, the both-side transport driving roller 41*a* rotates further through the angle θ1 and then stops.

Thereafter, the shared clutch 51 is turned on in a manner coordinated with the timing of image formation, and thus the intermediary driving roller 40*a*, the both-side transport driving roller 41*a*, and the registration driving roller 14*a* start to rotate. As a result, the sheet 26 is transported to the nip portion between the secondary transfer roller 9 and the driving roller 13 of the intermediary transfer belt 8; thus, secondary sheet feeding is started. An image is then formed on a first side of the sheet 26. To prevent the feed roller 30*a* and the pickup roller 29 from acting as a transport load during the secondary sheet feeding (with the sheet feed clutch 47 off), the feed roller 30*a* and the pickup roller 29 are provided with a one-way clutch so as to rotate passively.

In a case where both sides of the sheet 26 are subjected to image formation, the sheet 26 having an image formed on one side and then reversed is transported through the both-side transport passage 23 by the both-side transport roller pair 41. Then, immediately before the head end of the sheet 26 reaches the registration roller pair 14, the shared clutch 51 is turned off, so that the registration driving roller 14*a* immediately stops rotating.

Figure 12:
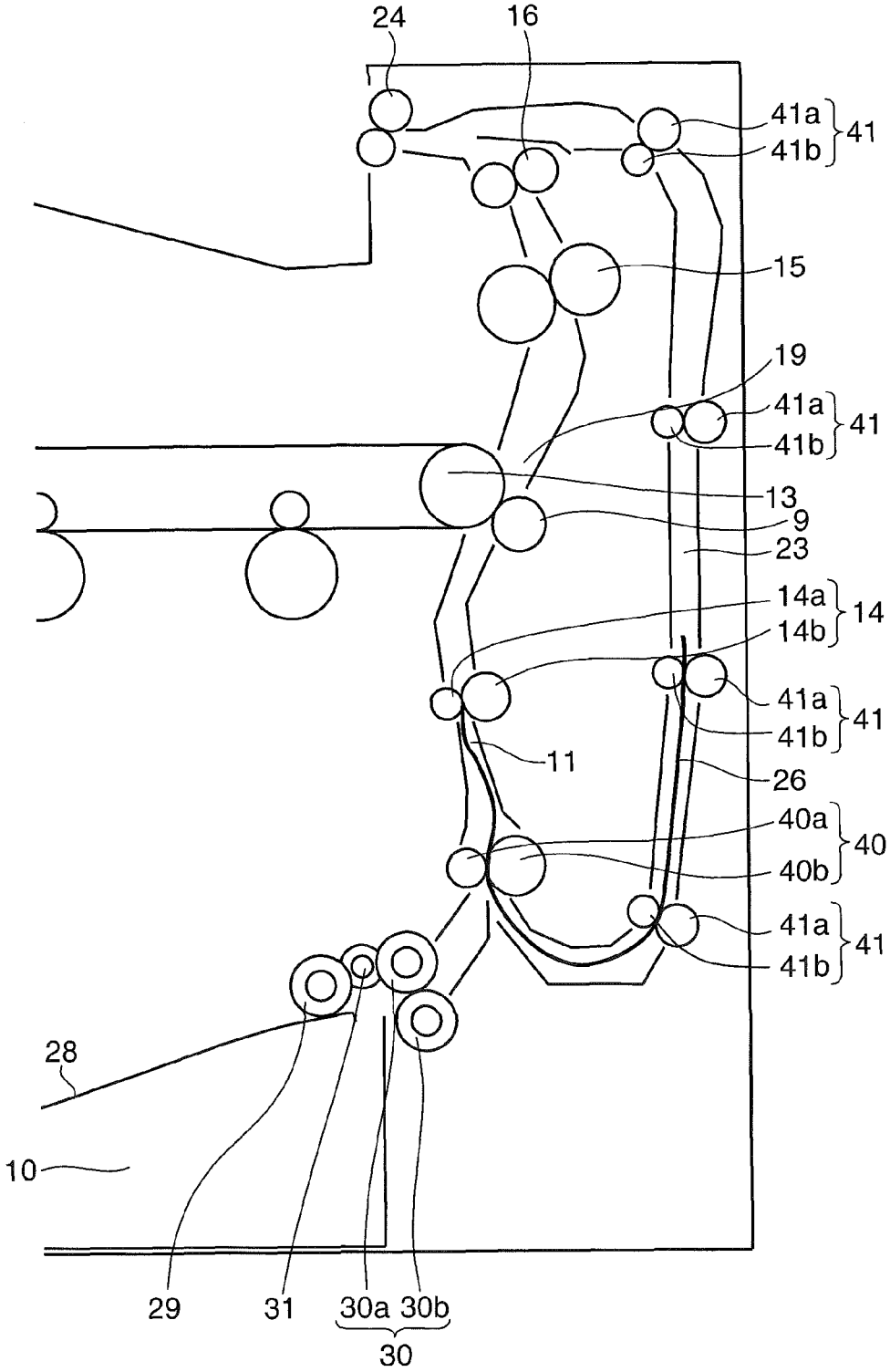
FIG. 12 is a sectional view showing a state where a warp is formed in a head-end part of a sheet that has passed through a both-side transport passage in an image forming apparatus according to one embodiment of the present disclosure.

At this point, owing to the resilient force (biasing force) of the biasing member 61, after the registration driving roller 14*a* has stopped, the intermediary driving roller 40*a* and the both-side transport driving roller 41*a* rotate further through the angle θ1 and then stop. Thus, as shown in FIG. 12, a warp is formed in a head end part of the sheet 26, and this corrects skew of the sheet 26.

Thereafter, the shared clutch 51 is turned on in a manner coordinated with the timing of image formation, and thus the intermediary driving roller 40*a*, the both-side transport driving roller 41*a*, and the registration driving roller 14*a* start to rotate. Thus, the sheet 26 is transported to the nip portion between the secondary transfer roller 9 and the driving roller 13 of the intermediary transfer belt 8; thus, secondary sheet feeding is started. Another image is then formed on a second side of the sheet 26.

The sheet 26 having images formed on both sides is discharged via the transfer roller pair 16 and the discharge roller pair 24 onto the discharge tray 18.

The operation of the image forming apparatus 100 (the clutches, the individual roller pairs, the driving motors, the image forming sections Pa to Pd, the fusing device 7, etc.) is controlled by a controller (unillustrated).

In this embodiment, as described above, there are provided a driving motor 70 which generates a rotating driving force for rotating the registration roller pair 14 and the intermediary roller pair 40; a shared clutch 51 which engages and disengages the transmission of the rotating driving force from the driving motor 70 to the registration roller pair 14 and the intermediary roller pair 40; and an upstream-side roller stop delay mechanism (a driving force transmission member 60, a intermediary roller gear 56, and a biasing member 61) which, when the shared clutch 51 disengages the transmission of the rotating driving force, delays the stopping of the intermediary roller pair 40 relative to the stopping of the registration roller pair 14. With this configuration, after the registration roller pair 14 stops rotating, the intermediary roller pair 40 can be rotated by the upstream-side roller stop delay mechanism to form a warp in the sheet 26. Thus, it is possible to correct skew of the sheet 26 without providing a motor and a clutch for each roller pair. It is also possible to reduce complexity in structure and an increase in cost compared with a case where a motor and a clutch are provided for each roller pair as in conventional image forming apparatuses. It is further possible to reduce the current that passes through the apparatus and thus to reduce electric power consumption and heat generation compared with a case where a motor and a clutch are provided for each roller pair.

Moreover, as described above, there is provided a biasing member 61 which biases the driving force transmission member 60 in the forward rotation direction. Thus, after the registration roller pair 14 stops rotating, the intermediary roller pair 40 can be rotated easily by the biasing member 61. It is thus possible to easily delay the stopping of the intermediary roller pair 40 relative to the stopping of the registration roller pair 14.

Moreover, the driving force transmission member 60 has a first engagement projection 60*a*, the intermediary roller gear 56 has a first engagement groove 56*a* which is engaged with the first engagement projection 60*a* in the rotation direction, and the first engagement groove 56*a* has such a length as to allow the first engagement projection 60*a* to rotate through an angle θ1 relative to the first engagement groove 56*a*. In this way, it is possible to restrict the angle through which the first engagement projection 60*a* can rotate relative to the first engagement groove 56*a*, and thus it is possible to make constant the angle through which the driving force transmission member 60 rotates after the intermediary roller gear 56 has stopped rotating. This makes it possible to give the sheet 26 a constant warp, and thus to stably correct skew of the sheet 26. In a case where a motor and a clutch are provided for each roller pair as in conventional image forming apparatuses, a delay (time lag) among control signals for different motors or different clutches may cause the warp in the sheet 26 to vary.

Moreover, as described above, the driving force transmission member 60 has a second engagement projection 60*b*, the intermediary roller gear 56 has a second engagement groove 56*b* which is engaged with the second engagement projection 60*b* in the rotation direction and which is formed to be longer than the first engagement groove 56*a* in the rotation direction, and the biasing member 61 is arranged in the second engagement groove 56*b* and biases the second engagement projection 60*b* in the forward rotation direction of the driving force transmission member 60. Thus, it is possible to secure a space to house the biasing member 61 in and thereby reduce an increase in apparatus size, and also to rotate the intermediary roller pair 40 more easily with the biasing member 61.

Moreover, as described above, an upstream-side roller stop delay mechanism (a driving force transmission member 60, a intermediary roller gear 56, and a biasing member 61) is provided on the rotary shaft 40*c* of the intermediary driving roller 40*a*. Thus, it is possible to control the rotation of the intermediary driving roller 40*a* directly with the upstream-side roller stop delay mechanism. It is thus possible to give the sheet 26 a more constant warp, and to correct skew of the sheet 26 more stably.

Moreover, as described above, the rotary shaft 40*c* of the intermediary driving roller 40*a* is provided with a one-way clutch 62 which restricts the rotation direction of the intermediary driving roller 40*a*. Thus, even when the biasing force of the biasing member 61 is weak, it is possible to prevent, with the one-way clutch 62, the intermediary driving roller 40*a* from being rotated in the reverse direction by a resilient force of the sheet 26 tending to cancel the warp when it is warped (in the states shown in FIGS. 11C and 12).

Moreover, as described above, there are provided a both-side transport roller pair 41 which receives a rotating driving force from the driving motor 70 via the shared clutch 51 and a both-side transport roller stop delay mechanism (a driving force transmission member, a both-side transport roller gear 59, and a biasing member 61) which, when the transmission of the rotating driving force is disengaged by the shared clutch 51, delays the stopping of the both-side transport roller pair 41 relative to the stopping of the registration roller pair 14. This eliminates the need to provide the both-side transport roller pair 41 with a dedicated motor or clutch. Thus, even in a case where there are provided a both-side transport passage 23 and a both-side transport roller pair 41, it is possible to reduce complexity in structure and an increase in cost, to reduce electric power consumption and heat generation, and to correct skew of the sheet 26.

It should be understood that the embodiments disclosed herein are all illustrative and not restrictive. The scope of the present disclosure is defined not by the description of the embodiments given above but by the appended claims, and encompasses all modifications and variations made in the sense and scope equivalent to those of the claims.

For example, although the embodiment deals with an example where the present disclosure is applied to a tandem-type color image forming apparatus as shown in FIG. 1, this is not meant to limit the application of the present disclosure. Needless to say, the present disclosure finds applications in a variety of image forming apparatuses provided with a feeding part and a transporting part, such as monochrome copiers, monochrome printers, digital multifunction peripherals, and facsimile machines.

Although the embodiment described above deals with an example where the driving force transmission member 60 is provided with a first engagement projection 60*a* and a second engagement projection 60*b* and the intermediary roller gear 56 (driving force transmission gear) is provided with a first engagement groove 56*a* and a second engagement groove 56*b*, this is not meant to limit the implementation of the present disclosure. Instead, the driving force transmission member 60 may be provided with only a first engagement projection 60*a* and the intermediary roller gear 56 (driving force transmission gear) may be provided with only a first engagement groove 56*a*.

What is claimed is:

1. An image forming apparatus comprising:

an image forming section which forms an image on a sheet;

a registration roller pair which is provided on an upstream side of the image forming section with respect to a sheet transport direction, the registration roller pair correcting skew of the sheet and adjusting timing of transport of the sheet in a manner coordinated with timing of image formation;

an upstream-side roller pair which is provided on an upstream side of the registration roller pair with respect to the sheet transport direction;

a driving force source which generates a rotating driving force for rotating the registration roller pair and the upstream-side roller pair;

a shared clutch which engages and disengages transmission of the rotating driving force from the driving force source to the registration roller pair and the upstream-side roller pair;

an upstream-side roller stop delay mechanism which, when the transmission of the rotating driving force is disengaged by the shared clutch, delays stopping of the upstream-side roller pair relative to stopping of the registration roller pair; and a rotary shaft which is provided between the shared clutch and the upstream-side roller pair in a driving force transmission pathway including the shared clutch and the upstream-side roller pair, wherein the upstream-side roller stop delay mechanism includes a driving force transmission member through which the rotary shaft is inserted, a driving force transmission gear in which the driving force transmission member is fitted and which transmits the driving force from the shared clutch to the driving force transmission member, and a biasing member which biases the driving force transmission member in a forward rotation direction relative to the driving force transmission gear, the forward rotation direction being a direction in which the driving force transmission member rotates during image formation, the driving force transmission member has a first engagement projection which engages with the driving force transmission gear, the driving force transmission gear has, in a side face thereof, a first engagement groove with an arc shape in which the first engagement projection is inserted and which has such a length as to allow the first engagement projection to rotate through a predetermined angle, and the first engagement groove has such a length as to allow the first engagement projection to rotate through a predetermined angle relative to the first engagement groove.

2. The image forming apparatus of claim 1, wherein the driving force transmission member has a second engagement projection which engages with the driving force transmission gear, the driving force transmission gear has, in a side face thereof, a second engagement groove with an arc shape in which the second engagement projection is inserted and which has such a length as to allow the second engagement projection to rotate through a predetermined angle, the second engagement groove is concentric with the first engagement groove and is longer than the first engagement groove, and the biasing member is arranged in the second engagement groove and biases the second engagement projection in the forward rotation direction of the driving force transmission member.

3. The image forming apparatus of claim 1, wherein the rotary shaft is a rotary shaft of one of rollers constituting the upstream-side roller pair.

4. The image forming apparatus of claim 1, wherein a rotary shaft of one of rollers constituting the upstream-side roller pair is provided with a one-way clutch which restricts rotation direction of the one of the rollers constituting the upstream-side roller pair.

5. The image forming apparatus of claim 1, further comprising:

a both-side transport roller pair which is provided in a both-side transport passage through which the sheet having an image formed on one side and then reversed is directed to the registration roller pair, the both-side transport roller pair receiving the rotating driving force from the driving force source via the shared clutch; and a both-side transport roller stop delay mechanism which, when the transmission of the rotating driving force is disengaged by the shared clutch, delays stopping of the both-side transport roller pair relative to stopping of the registration roller pair.

* * * * *